US005435774A

United States Patent [19]

Naujok

[11] Patent Number: 5,435,774

[45] Date of Patent: Jul. 25, 1995

[54] APPARATUS FOR HOLDING GEMSTONES TO BE POLISHED

[76] Inventor: Robert Naujok, 19119 Rockville Rd., Kiel, Wis. 53042

[21] Appl. No.: 192,335

[22] Filed: Feb. 4, 1994

[51] Int. Cl.[6] ..... B24B 3/36

[52] U.S. Cl. ..... 451/364; 451/389

[58] Field of Search ..... 51/229, 216 A, 216 CP; 451/389, 405, 364, 392, 394, 397, 398, 404

[56] References Cited

U.S. PATENT DOCUMENTS

| | | | |
|---|---|---|---|
| 558,734 | 4/1896 | Loesser | 51/229 |
| 558,909 | 4/1896 | Loesser | 51/229 |
| 1,103,698 | 7/1914 | Soetens | 51/229 |
| 2,450,984 | 10/1948 | Pastore | 51/229 |
| 2,530,421 | 11/1950 | Burness et al. | 51/229 |
| 2,534,384 | 12/1950 | Spira | 51/229 |
| 3,559,349 | 2/1971 | Imahashi | 51/229 |
| 4,201,018 | 5/1980 | Pool | 51/229 |
| 4,254,587 | 3/1981 | Wilson | 51/229 |
| 4,667,446 | 5/1987 | Imahashi | 51/229 |

*Primary Examiner*—Maurina T. Rachuba
*Attorney, Agent, or Firm*—Wheeler & Kromholz

[57] ABSTRACT

A dop, a tang, and the combination of the two structures. The dop has an arc of movement of at least 75 degrees and as much as 95 degrees. The dop has an arcuate surface having an arc of movement of at least 95 degrees and a gear having key ways. The arcuate surface having keys extending substantially the entire arc of movement and the keys interdigitating with the key ways. The tang has a butt end, a neck, a clamp end connected to the neck and opposite the butt end, a clamp connected to the clamp end. The butt end including a platform structure integral to the neck and a support structure having a base. The support structure movably connected to the platform structure by a first adjustment tool. The support structure further including a second plurality of adjustment tools connected to the base. The first adjustment tool capable of being operated independently from the second plurality of adjustment tools so that the platform structure may be moved relative to the support structure and the base may be moved relative to the support structure. The dop and tang being combined by connecting each other via the clamp on the clamp end of the tang.

14 Claims, 6 Drawing Sheets

APPARATUS FOR HOLDING GEMSTONES TO BE POLISHED

BACKGROUND OF THE INVENTION

The present invention relates generally to the field of gemstones, e.g. diamonds, and more specifically to the field polishing and faceting gemstones. In particular, the present invention is directed toward a new design for a tang and a dop.

Gemstone polishing is an old art going back many centuries. In many ways the practice of gemstone polishing remains the same today as it did long ago. Gemstone polishing required a steady and firm structure to hold the gemstone, a stable platform to hold the gemstone in the desired position, and polishing surface for polishing the gemstone.

These requirements led to the development of the dop (typically a piece of lead into which the gemstone was imbedded with the surface to be polished exposed) to hold the gemstone, the tang to hold the dop and provide a stable platform, and the polishing wheel (usually mounted on a table called a sleigh) against which the desired surface of the gemstone may be held to be polished. These developments provided gemstone polishers with tools that allowed them greater control over the polishing process.

As noted above, in gemstone polishing the tang is a device for holding the dop. The tang basically comprises two main parts: the butt which is the wooden rear end and the clamp which is made of steel and extends forward from the butt. The butt is broad at the rear with a fiat top on which the fiat lead weights can be placed when pressure on the tang is required. Beneath the butt are two legs which rest on the steel plate of the bench. At the rear is the tail or steel rod which helps to hold the tang in position when placed in the sleigh.

The clamp's neck is fixed to the fore-end of the butt. The front or head of the clamp is split and held together by a bolt and nut. When the nut is tightened the clamp shuts and holds the copper stalk of the dop in a groove near the end of the head.

The dop is the apparatus that holds the gemstone in proper position for polishing. Dops were originally made from lead but have many different shapes and some even resemble the chuck of drill.

Essentially, the combination of the tang and the dop with a gemstone creates a three pointed structure with the gemstone as the third point. The third point that is the gemstone rests on the polishing wheel as it operates. In this manner each facet of the gemstone is polished.

The present invention is directed at improvements in the dop, mounting the dop to the tang, and the tang itself. Current tangs have a fairly complex structure, including springs, that make adjustment difficult. The present invention provides a tang of unique and simple design that requires no springs or tails and is easily adjusted and readjusted. Also, the tang of the present invention is designed to present a stable base regardless of the height of the tang.

Further, the manner in which the dop is currently constructed and connected to the tang results in a limited arc of movement. This limited arc of movement is 0 to 50 degrees. The pivot point is the end of the dop and not the gemstone. Accordingly, the polisher must take the size of the gemstone, a diamond for example, into account when positioning the dop and the tang for polishing. The present invention by a unique and simple design eliminates this problem by allowing the polisher to use the gemstone itself as the reference or pivot point and at the same time allows the user a potential arc of movement of −5 to 90 degrees. This allows the polisher to easily polish or facet gemstones at angles that have hither to been unobtainable.

The inventor knows of no prior art that either teaches or shows the technology of the present invention. The most authoritative prior art reference of which the inventor is aware regarding this technology in the book *Diamond Cutting,* By Basil Watermeyer, 4th ed., printed and bound by Perskor, Doornfontein, Johannesburg, South Africa.

SUMMARY OF THE INVENTION

The present invention is a dop, a tang, the combination of the two structures. The dop is essentially designed to have an arc of movement of at least 75 degrees and as much as 95 degrees. The tang is designed to be easily adjustable.

The dop of the present invention may be broadly summarized as having an arcuate surface having an arc of movement of 95 degrees and a gear having key ways. The arcuate surface having keys extending substantially the entire arc of movement and at least a portion of the keys interdigitating with the key ways.

The dop being designed so that the pivot point of the arc of movement of the arcuate surface is substantially a gemstone held in the dop.

The tang has a butt end, a neck, a clamp end connected to the neck and opposite the butt end, a clamp connected to the clamp end. The butt end includes a platform structure integral to the neck and a support structure having a base. The support structure is movably connected to the platform structure by a first adjustment tool. The support structure further including a second plurality of adjustment tools connected to the base. The first adjustment tool capable of being operated independently from the second plurality of adjustment tools so that the platform structure may be moved relative to the support structure and the base may be moved relative to the support structure.

The dop and tang being combined by connecting each other via the damp on the clamp end of the tang.

These and other benefits of the present invention will be apparent to one skilled in the art from the following description.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
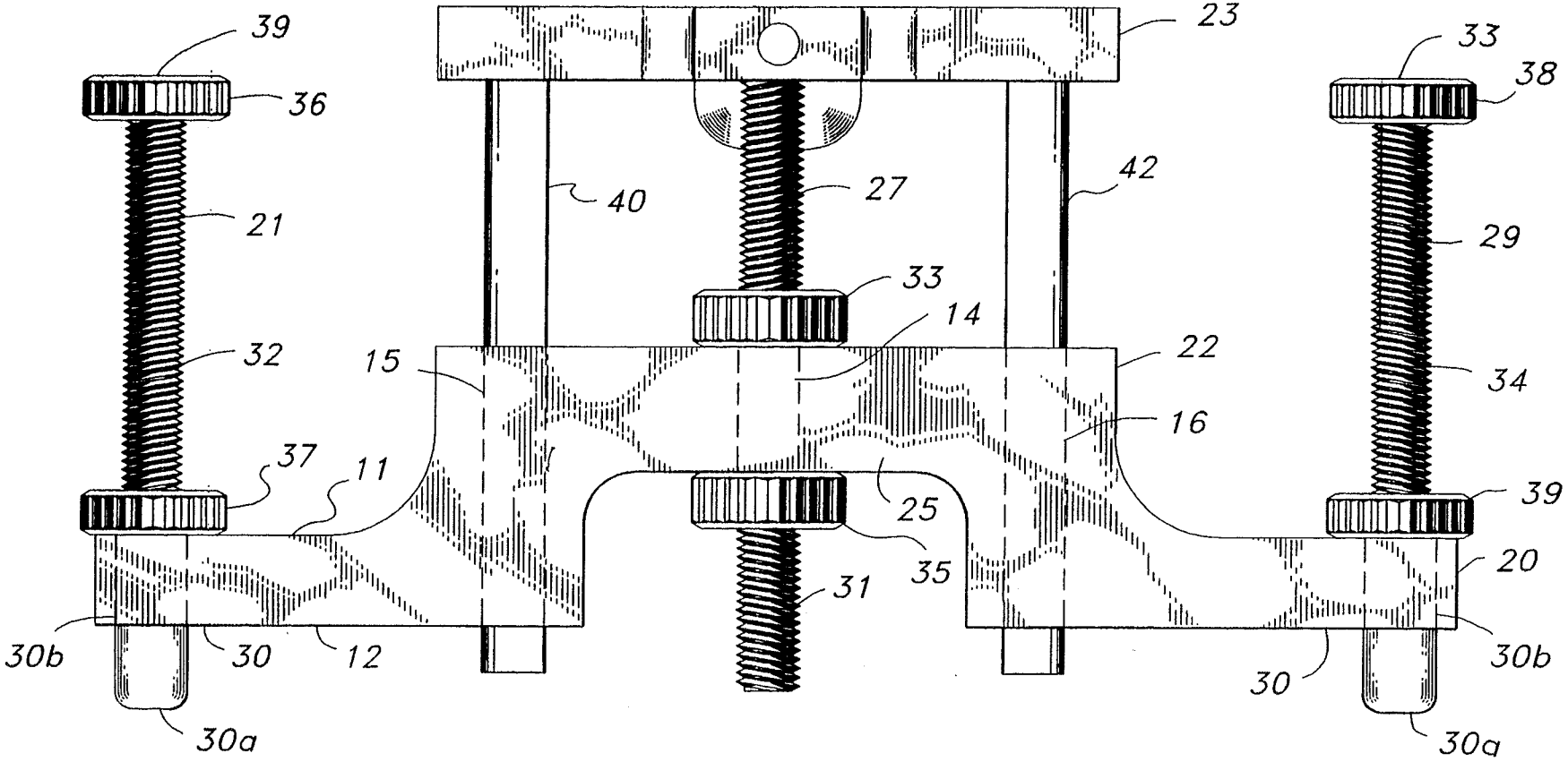
FIG. 1 is an elevational end view of the tang of the present invention.
Figure 2:
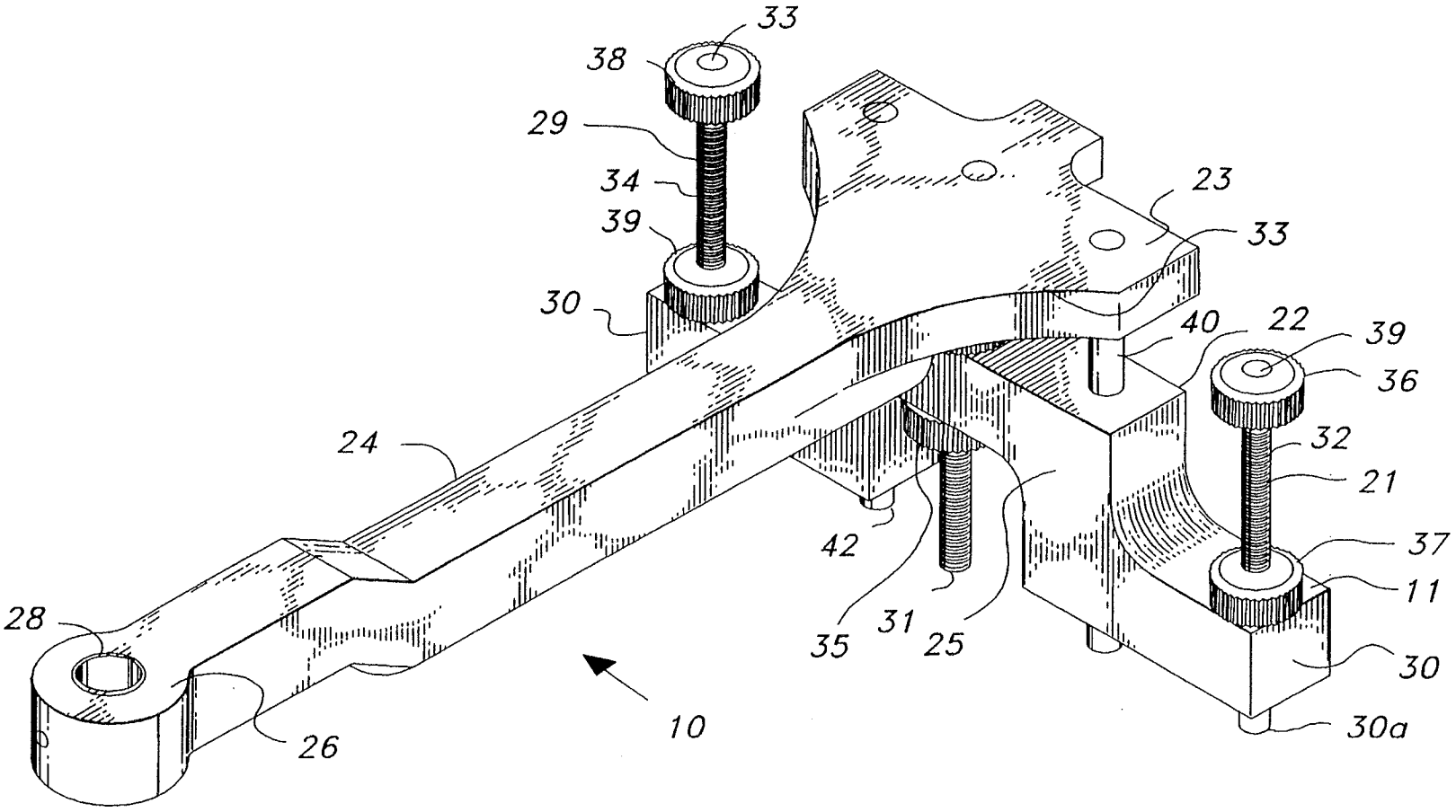
FIG. 2 is a perspective view of the tang of the present invention.
Figure 3:
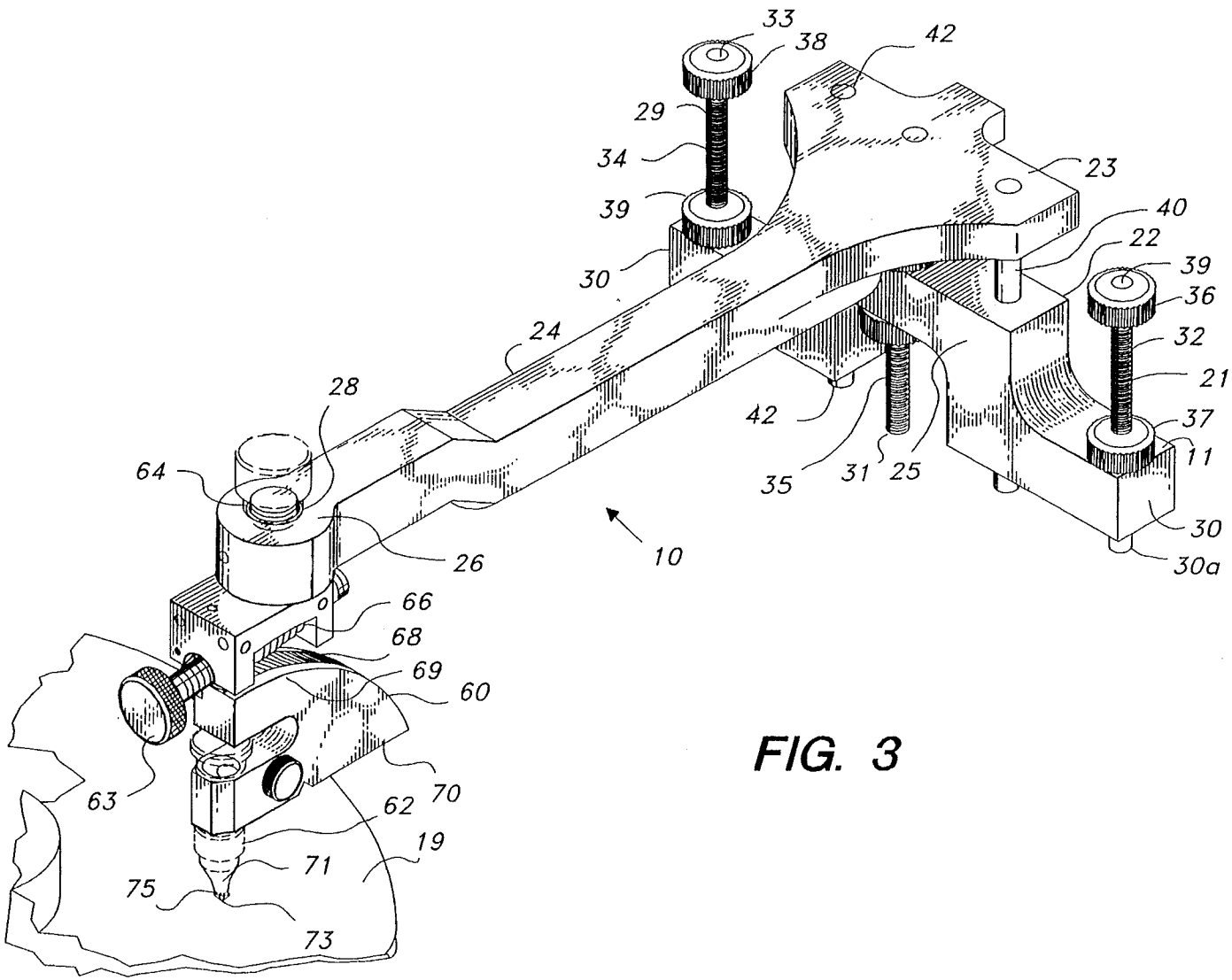
FIG. 3 is perspective view of the tang engaged with dop of the present invention holding a diamond on a polishing wheel.
Figure 4:
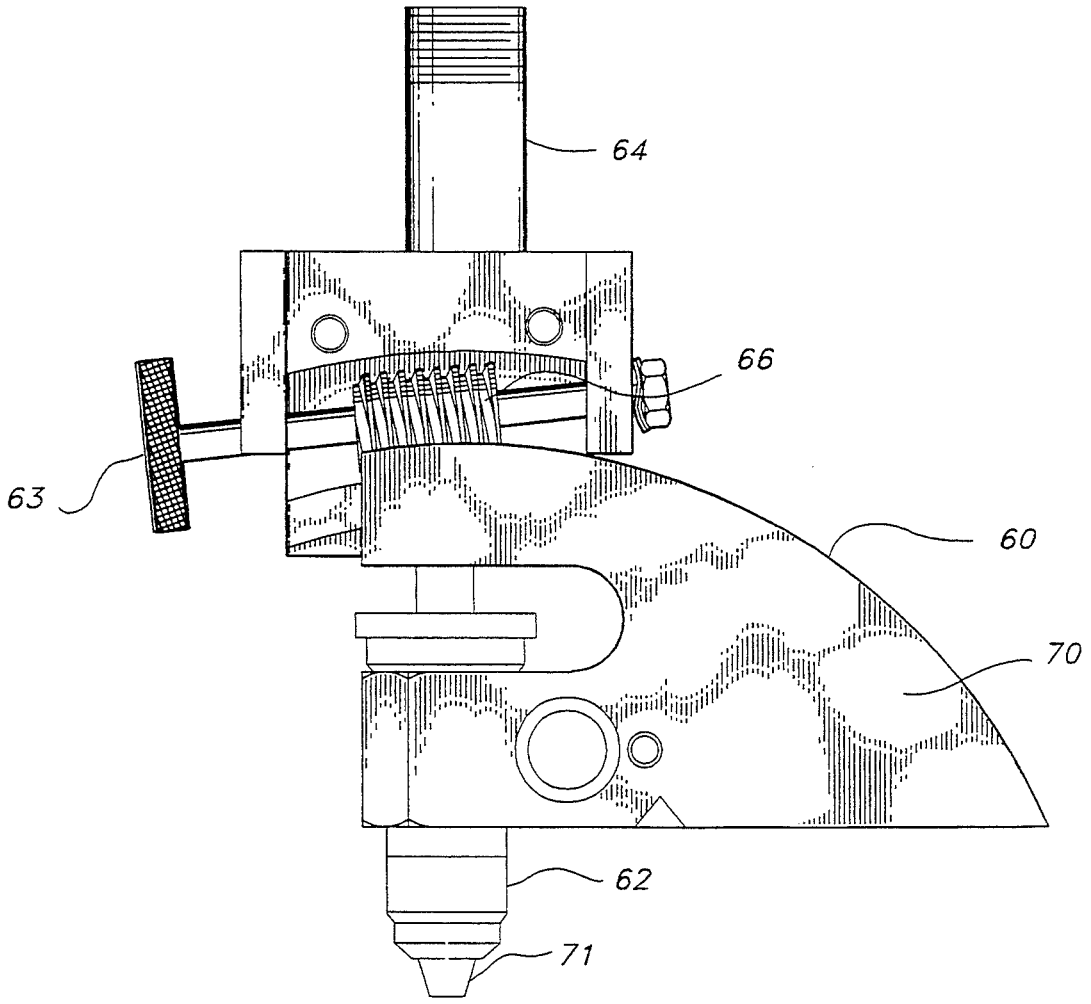
FIG. 4 is a side elevational view of the dop assembly.
Figure 6:
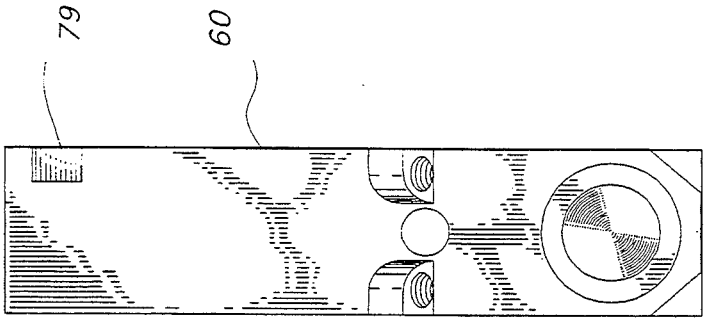
FIG. 6 is a bottom view of the dop assembly.
Figure 5:
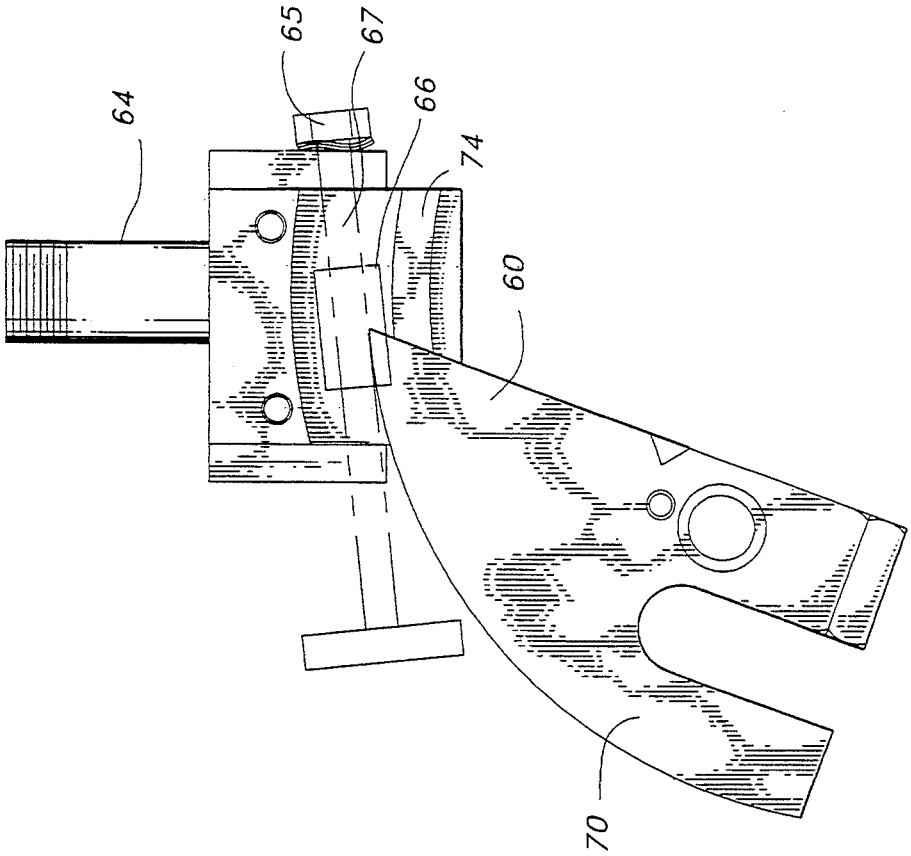
FIG. 5 is a schematic view showing the dop assembly extended to is maximum.

Referring to FIGS. 1–3 the tang 20 of the present invention 10 may be seen. The tang 20 is composed of a butt end 22, a neck 24, a clamp end 26 opposite the butt end 22, and a clamp 28.

The butt end 22 is comprised of a platform 23 that is integral to the neck 24 and movably connected to a supporting base 25. The support base 25 is movably connected to the platform 23 by adjustment tool 27. The support base 25 is further stabilized by shafts 40 and 42 which are slidably engaged in openings 15 and 16. The supporting base further includes adjustment tools 21 and 29 connected to the feet 30 of the base 25.

Stir referring to FIGS. 1–3 the adjustment tool 27 may be seen to be the combination of a threaded bolt 31 and two nuts 33 and 35. Adjustment tools 21 and 29 may be seen to be the respective combinations of threaded bolts 32 and 34 with nuts 36, 37, 38, and 39.

Preferably, the support feet 30 will be supported by posts 30*a* made of a slippery material. Each of the support feet 30 has a threaded opening 30*b* extending through it from the top 11 of the base 25 though the bottom 12 of the base 25. The bolts 32 and 34 are respectively engaged with each opening of each foot 30 and each post 30*a*.

Nuts 36 and 38 are fixed at the tops 39 and 33 of the bolts 32 and 34. Nuts 37 and 39 are turnably engaged with the bolts 32 and 34 respectively. Turning nuts 36 and 38 will move the base up and down the respective bolts. This movement will be impeded or stopped depending upon the location of the nuts 37 and 39.

Nuts 37 and 39 are used to set a predetermined distance that the bolts 32 and 34 can be adjusted to move the base 25 upward. Further, nuts 37 and 39 can be used to lock the base 25 into a particular raised position thereby accurately holding the base 25 in the desired position without drift or loss of position during the polishing process. Additionally, adjustment of nuts 37 and 39 allows the user to level the platform 23.

Likewise, threaded bolt 31 may be used to move the platform 23 either away from or towards the base 25 by adjusting nuts 33 and 35; without disturbing the level condition established by bolts 32 and 34. This is accomplished easily since the opening 14 in the base 25 is not threaded. Consequently, structures other than a bolt and two nuts could be used for this purpose; e.g. a shaft having a square cross section and a pair of damps. Accordingly, the support base 25 and the platform 23 may be moved independently of each other with respect to each other.

Referring now to FIGS. 3–7 the dop assembly 60 of the present invention 10 may be seen. The dop assembly 60 includes a dop 62, a mounting post 64 that is engaged with the clamp 28 of the clamp end 26 of the tang 20, an adjustment screw 63 having a worm gear 66 engaged with a series of gear teeth 68 carved into an arcuate surface 69 which is integral to an arcuate body 70 that is connected the bit 71 into which the gemstone 73 that is to be polished is mounted.

As can be seen from the FIGS. 4–7, the arc of movement of the arcuate surface 69 is such that the gemstone 73 is substantially the pivot point 75 for the arc of movement 77. In this manner a high degree of precision control over the exact position and angle of the gemstone 73 is maintained.

Still referring to FIGS. 4–7 the dop assembly 60 can be seen to be further comprised of an arcuate body 70 that is machined to have a track that rides on rail 74 of the dop assembly 60. The arcuate body 70 of the present invention is made from machined metal, e.g. brass or aluminum, and will easily move on the rail 74.

Figure 7:
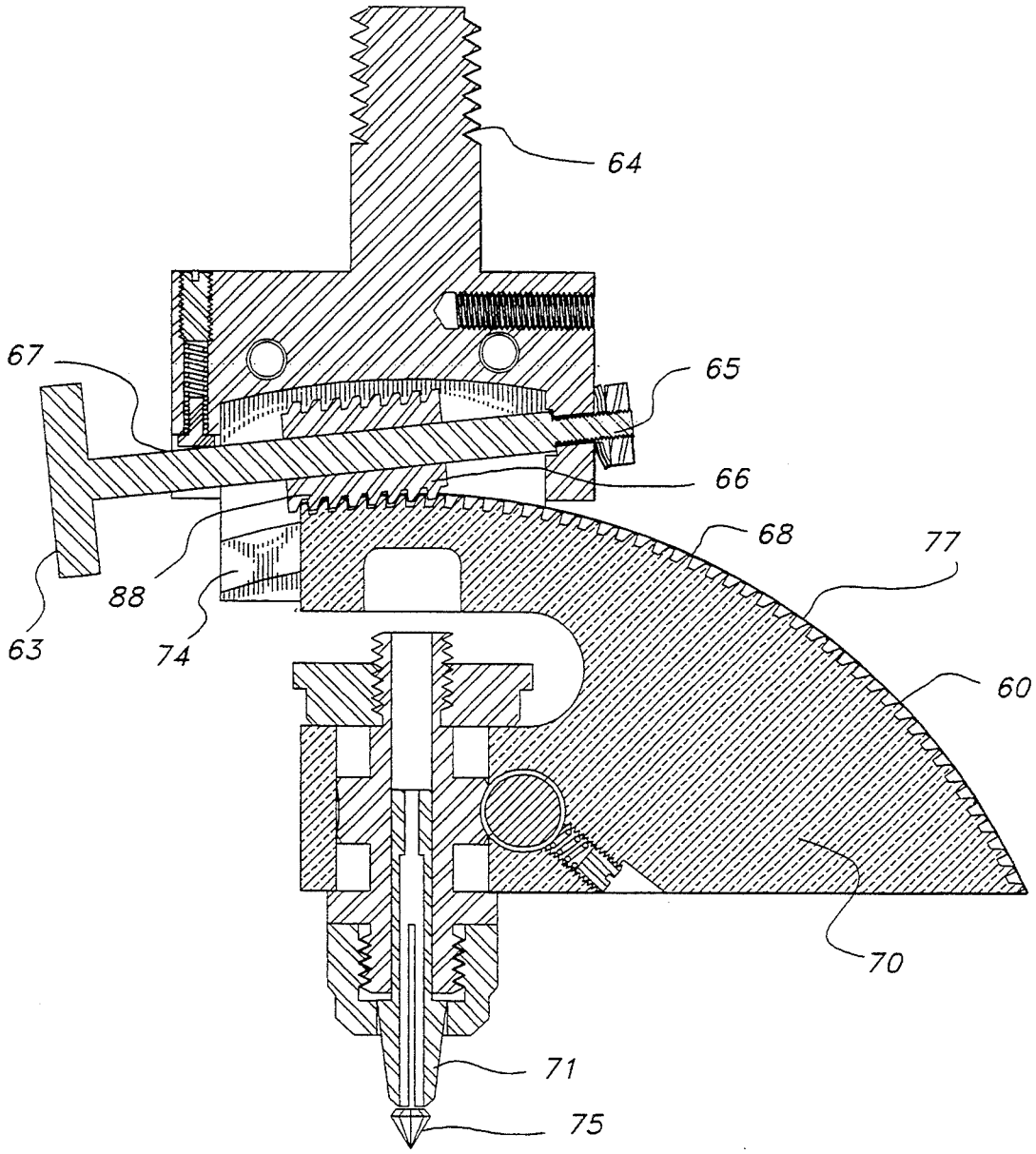
FIG. 7 is a cutaway side view of the dop assembly.

As may be seen by referring to FIG. 7, the inner workings of the dop assembly 60 may be seen. The screw 63 may be seen to have a shaft 67 that has an end 65 that is fixed against axial movement but not rotational movement. On roughly the mid point of the shaft 67 the worm gear 66 is located. The gear teeth 68 or keys of the arcuate surface 69 engage the spaces 88 or key ways of the worm gear 66. Accordingly, since the arcuate body 70 may freely travel on the raft 74 the movement of the arcuate body 70 is controlled by turning the screw 63 and actuating the worm gear 66. This allows the user to control the movement of the arcuate body 70 and thus the movement of the arcuate surface 69 around the gemstone pivot point 75 accurately. The accuracy and precision of the movement can be controlled by selecting the desired number of gear teeth 68 or keys and spaces 88 or key ways on the respective arcuate surface 69 and worm gear 66. Increasing the number will increase the precision of the dop assembly 60.

Finally, referring to FIG. 3 the operation of the present invention 10 may be seen to be as follows: The polishing wheel 19 is set in motion and the dop assembly 60 is set at the desired angle for polishing the gemstone 73, e.g. a diamond. The level of the tang 20 is also set. The facet of the gemstone 73 desired to be polished is then applied to the polishing wheel 19 for the time desired.

The adjustment screw 63 is essentially a worm gear 66 engaged with the gear teeth 68 of the arcuate surface 69. The arcuate body 70 of the dop 60 is machined to engage the track 79 so that a turn of the screw 63 will easily and accurately move the arcuate surface 69 the desired number of degrees and present the gemstone 73 at the desired angle.

The foregoing is considered as illustrative only of the principles of the invention. Furthermore, since numerous modifications and changes will readily occur to those skilled in the art, it is not desired to limit the invention to the exact construction and operation shown and described.

What is claimed is:

1. A tang for use on a bench, the tang comprising:
   - a butt end, a neck, a clamp end opposite the butt end, and a clamp;
   - the butt end including a platform structure integral to the neck;
   - a support structure having a base, the support structure movably connected to the platform structure by a first adjustment tool;
   - the support structure further including a second adjustment tool and a third adjustment tool each connected to the base and extending to the bench;
   - the first adjustment tool capable of being operated independently from the second plurality of adjustment tools so that the platform structure may be moved relative to the support structure.

2. The tang of claim 1 in which the platform structure has a substantially flat top surface.

3. The tang of claim 1 in which the base has a top, a bottom, and a first opening and the first adjustment tool includes at least two adjustment nuts and a threaded shaft;

the first adjustment nut being located on top of the base and aligned with the first opening;

the second adjustment nut being located on the bottom of the base aligned with the first opening;

the threaded shaft having a first end connected to the platform structure and extending through the first adjustment nut, the first opening, and the second adjustment nut.

4. The tang of claim 3 in which the base includes two support feet, each foot having a top and a bottom;

a threaded opening extending from the top of each foot through to the bottom of each foot; and second and third threaded shafts respectively engaged with each threaded opening of each foot.

5. The tang of claim 3 in which the threaded shaft is a bolt.

6. The tang of claim 4 in which the second and third threaded shafts are bolts.

7. A dop assembly comprising:

a mounting mechanism having at least one aperture and an arcuate rail formed therein;

an arcuate body having an arcuate surface, the arcuate surface having a plurality of gear teeth;

an adjustment mechanism having a shaft;

the shaft rotatably mounted in the aperture and having a worm gear axially mounted thereon;

the worm gear engaged with the arcuate surface gear teeth;

a track attached to the arcuate body and riding in the arcuate rail.

8. The dop assembly of claim 7 wherein a bit for holding a gemstone is attached to the arcuate body.

9. The combination of the dop assembly of claim 7 with a tang for use on a bench comprising:

a tang for use on a bench, the tang comprising:

a butt end, a neck, a clamp end opposite the butt end, and a clamp;

the butt end including a platform structure integral to the neck;

a support structure having a base, the support structure movably connected to the platform structure by a first adjustment tool;

the support structure further including a second adjustment tool and a third adjustment tool each connected to the base and extending to the bench;

the first adjustment tool capable of being operated independently from the second plurality of adjustment tools so that the platform structure may be moved relative to the support structure.

10. A dop assembly for holding a gemstone and the gemstone is the pivot point for the dop assembly arc of movement, the dop assembly comprising:

an arcuate body having an arcuate surface and having an arc of movement of at least 95 degrees;

the arcuate surface having keys extending substantially the arc of movement;

a worm gear having worm gear key ways rotatably mounted in a mounting mechanism, the worm gear key ways interdigitating with the arcuate surface keys;

an arcuate track attached to the arcuate body and an arcuate rail formed in the mounting mechanism;

the track riding in the rail.

11. The dop assembly of claim 10 further including an adjustment mechanism attached to the worm gear.

12. A dop assembly for holding a gem stone and the gemstone is the pivot point for the dop assembly arc of movement of at least 95 degrees, the dop assembly comprising:

a mounting device having a worm gear rotatably attached;

the worm gear having a plurality of key ways and an adjustment screw;

an arcuate body having an arcuate surface and a plurality of keys formed in the arcuate surface;

the worm gear key ways interdigitating with a portion of the arcuate surface keys;

an arcuate rail formed in the mounting device and a track attached to the arcuate body, the track riding in the arcuate rail;

a bit for holding the gem stone attached to the arcuate body;

a mounting post attached to the mounting device.

13. A dop assembly for holding a gem stone and the gemstone is the pivot point for the dop assembly arc of movement of at least 95 degrees, the dop assembly comprising:

an arcuate body having an arcuate surface including gear teeth extending substantially over the arcuate surface and having a track;

a mounting mechanism having an arcuate rail and having a worm gear attached to an adjustment screw rotatably mounted within the mechanism;

a bit for holding the gemstone attached to the arcuate body;

the worm gear engaging the gear teeth and the track riding in the rail such that the arcuate body pivots relative to the mounting mechanism.

14. The combination of the dop assembly of claim 13 with a tang for use on a bench comprising:

A tang for use on a bench, the tang comprising:

a butt end, a neck, a clamp end opposite the butt end, and a clamp;

the butt end including a platform structure integral to the neck;

a support structure having a base, the support structure movably connected to the platform structure by a first adjustment tool;

the support structure further including a second adjustment tool and a third adjustment tool each connected to the base and extending to the bench;

the first adjustment tool capable of being operated independently from the second plurality of adjustment tools so that the platform structure may be moved relative to the support structure.

* * * * *